US007685789B2

(12) United States Patent
Houben

(10) Patent No.: US 7,685,789 B2
(45) Date of Patent: Mar. 30, 2010

(54) CONSTRUCTION ELEMENT AND METHOD FOR MANUFACTURING IT

(75) Inventor: Ewald Houben, Houthalen (BE)

(73) Assignee: Gecoleng Aktiengesellschaft, Zug (CH)

( * ) Notice: Subject to any disclaimer, the term of this patent is extended or adjusted under 35 U.S.C. 154(b) by 978 days.

(21) Appl. No.: 10/526,465

(22) PCT Filed: Sep. 15, 2003

(86) PCT No.: PCT/BE03/00153

§ 371 (c)(1),
(2), (4) Date: Mar. 3, 2005

(87) PCT Pub. No.: WO2004/027178

PCT Pub. Date: Apr. 1, 2004

(65) Prior Publication Data

US 2005/0284071 A1 Dec. 29, 2005

(30) Foreign Application Priority Data

Sep. 23, 2002 (BE) ..... 2002/0553

(51) Int. Cl.
*E04C 3/30* (2006.01)

(52) U.S. Cl. ..... 52/576; 52/414; 52/381; 52/323; 52/335

(58) Field of Classification Search ..... 52/320, 52/323, 380, 576, 742.14, 745.13, 745.2, 52/335, 252, 259, 258, 332, 414, 577, 381
See application file for complete search history.

(56) References Cited

U.S. PATENT DOCUMENTS

| | | | | | |
|---|---|---|---|---|---|
| 1,095,204 | A | * | 5/1914 | Golding | 52/329 |
| 1,278,908 | A | * | 9/1918 | Goldsmith | 52/323 |
| 1,313,500 | A | * | 8/1919 | Birdsey | 52/125.3 |
| 1,732,303 | A | * | 10/1929 | Goldsmith | 52/577 |
| 1,767,067 | A | * | 6/1930 | Goldsmith | 52/323 |
| 3,213,581 | A | * | 10/1965 | Macchi | 52/382 |
| 3,557,511 | A | * | 1/1971 | Curran | 52/414 |
| 3,956,864 | A | * | 5/1976 | Fung | 52/414 |
| 4,056,908 | A | * | 11/1977 | McManus | 52/334 |
| 4,495,744 | A | * | 1/1985 | Carl | 52/576 |
| 4,702,048 | A | * | 10/1987 | Millman | 404/34 |
| 5,797,230 | A | * | 8/1998 | Lassen | 52/323 |
| 5,930,965 | A | * | 8/1999 | Carver | 52/320 |
| 6,000,194 | A | * | 12/1999 | Nakamura | 52/783.17 |
| 6,041,561 | A | * | 3/2000 | LeBlang | 52/234 |
| 6,205,737 | B1 | | 3/2001 | Häussler | |

(Continued)

FOREIGN PATENT DOCUMENTS

DE 100 04 640 8/2001

(Continued)

*Primary Examiner*—Richard E Chilcot, Jr.
*Assistant Examiner*—Chi Q Nguyen
(74) *Attorney, Agent, or Firm*—Bacon & Thomas, PLLC

(57) ABSTRACT

Construction element for forming a reinforced concrete slab (2), consisting of the combination of at least a hardened concrete layer (3), at least a number of reinforcement elements (4) and elements (5) extending at least partially from the concrete layer (3) and defining cavities (6), whereby these elements (5) are designed to be covered with concrete (7) at a later stage characterised in that the above-mentioned elements (5) defining the cavities (6) consist of elements (5) which can be mutually nested as such.

12 Claims, 3 Drawing Sheets

U.S. PATENT DOCUMENTS

| | | | | |
|---|---|---|---|---|
| 6,708,459 | B2 * | 3/2004 | Bodnar | 52/356 |
| 6,837,013 | B2 * | 1/2005 | Foderberg et al. | 52/356 |
| 7,134,805 | B2 * | 11/2006 | Yee | 404/50 |
| 2002/0043045 | A1 * | 4/2002 | Marino Del Din | 52/783.1 |
| 2003/0163965 | A1 * | 9/2003 | Hydock | 52/342 |

FOREIGN PATENT DOCUMENTS

| | | |
|---|---|---|
| EP | 658 663 | 6/1995 |
| FR | 2 006 654 | 1/1970 |
| GB | 1 312 349 | 4/1973 |

* cited by examiner

CONSTRUCTION ELEMENT AND METHOD FOR MANUFACTURING IT

BACKGROUND OF THE INVENTION

A. Field

The present invention concerns a construction element, in particular a construction element for forming a reinforced concrete slab, as well as a method for manufacturing such a construction element.

B. Related Art

In particular, it concerns a construction element of the type which consists of the combination of at least a hardened concrete layer, at least a number of reinforcement elements and elements extending at least partially from the concrete layer and defining cavities, whereby these elements are designed to be covered with concrete in the factory or on the building site at a later stage.

With the known embodiments of this type of construction elements, use has been made until now of spherical elements for the cavities, in particular balls or the like, which are slightly embedded at the bottom in the concrete layer and are moreover kept in place by means of mutually connected reinforcement nets, a first reinforcement net situated under the spherical elements in the concrete layer and a second reinforcement net extending above the spherical elements respectively. The second reinforcement net is hereby meant to keep the spherical elements in place, in particular to lock them against floating at the time when liquid concrete is poured over it.

These known embodiments have several disadvantages.

The hollow spherical elements, which are usually manufactured in another place than the construction elements themselves, result in high transport costs, as they occupy a relatively large volume, although they have a low weight. Another disadvantage consists in that these spherical elements are difficult to manipulate, especially in an automated process.

Another disadvantage of these known embodiments consists in that their manufacture is rather complex, as the construction element as such already has to be provided with a top reinforcement net, which moreover preferably has to be provided on it in a very precise manner in order to make sure that the spherical elements are locked in the required positions.

Another disadvantage of these known embodiments consists in that the spherical elements rest against the top reinforcement net or can make contact with it as a result of floating, so that, after the liquid concrete has been poured over the construction element, the top reinforcement net cannot be optimally embedded in the concrete. In practice, this can be remedied by making use of separate locking elements which are connected to the top side of the spherical elements in order to prevent the spherical elements from floating, but this is disadvantageous in that the construction as a whole becomes complex and time-consuming.

Also, the present invention aims a construction-element of the aforesaid type, whereby one or several of the above-mentioned disadvantages are excluded.

BRIEF SUMMARY OF THE INVENTION

To this end, the invention in the first place concerns a construction element for forming a reinforced concrete slab, consisting of the combination of at least a hardened concrete layer, at least a number of reinforcement elements and elements extending at least partially from the concrete layer and defining cavities, whereby these elements are designed to be covered with concrete at a later stage, characterised in that the above-mentioned elements defining the cavities consist of elements which can be mutually nested as such. As the elements can be mutually nested as such, this offers the advantage that they can be nested in each another during the transport from the place where these elements have been made to the place where the construction elements will be manufactured, which offers the advantage that the ensuing transport costs can be considerably reduced. Such nestable elements also offer the advantage that they can be more easily manipulated than merely spherical elements which are difficult to hold, especially in the case of an automated process.

According to the most preferred embodiment, the above-mentioned elements can be nested in each other for at least 50%, and better still for at least 75%, as a result of which they occupy a very small volume during transport.

Preferably, the above-mentioned elements have one or several of the following qualities:

- that they are made mainly conical, which makes them easy to nest and which also offers the advantage that, after concrete has been poured over the construction element, a concrete slab is obtained whereby the amount of concrete systematically increases from bottom to top, as a result of which the amount of concrete is restricted to a minimum in the tensile region, while this amount gradually increases towards the pressure zone;
- that they consist of one or several side walls and a top wall, while they are open on the bottom side, so that they can be easily pushed in the concrete and can be embedded;
- that they have the shape of a flower pot which has been turned upside down, which shape is easy to realise in a mould;
- that they are each provided with at least one air hole, which offers the advantage that, when these elements are partially embedded in the concrete of the concrete layer, the air can escape thereof;
- that they are each made in one piece, so that no additional mounting steps are required to for example assemble these elements;
- that they are made of plastic or another usable material, such as for example compressed waste of tetra-brics or resin-bonded fibres or the like, as a result of which they can be made very cheap and will moreover have a minimum weight;
- that they are circular or many-sided seen in the horizontal cross section, so that, when put in the concrete layer, no attention has to be paid to their position of rotation, whereby other shapes are not excluded, however;
- that they are provided with locking parts at the bottom which are designed to be embedded in the concrete layer, thereby either or not catching behind reinforcement elements which are also embedded in this concrete layer, so that a sound interlocking can be realised in the underlying concrete layer, preferably even such that no extra interlocking will have to be further provided on the top side in order to prevent the elements from floating.

Secondly, the invention also concerns a construction element for forming a reinforced concrete slab, consisting of the combination of at least a hardened concrete layer, at least a number of reinforcement elements and elements extending at least partially from the concrete layer and defining cavities, whereby these elements are designed to be covered with concrete at a later stage, characterised in that the above-mentioned elements are anchored to the construction element, only via a part thereof with which they rest in the concrete layer, being thereby either or not locked to the reinforcement which has been embedded in said concrete layer, by means of an anchoring which is so solid that said elements will at least stay anchored against floating when liquid concrete or cast concrete is poured over them. This offers the advantage that no extra anchoring will have to be further provided on the top side, which makes the construction of the construction element considerably simpler, and which also creates more possibilities to afterwards provide a top reinforcement in the concrete layer as desired.

Thirdly, the invention also concerns a construction element for forming a reinforced concrete slab, consisting of the combination of at least a hardened concrete layer, at least a number of reinforcement elements and elements extending at least partially from the concrete layer and defining cavities, whereby these elements are designed to be covered with concrete at a later stage, characterised in that the construction element comprises supporting means for a top reinforcement, whereby these supporting means define supporting parts which are situated higher than the top sides of the aforesaid hollow elements. This construction element offers the advantage that, when a top reinforcement is provided on the above-mentioned supporting parts, it is mainly excluded that this top reinforcement rests on the hollow elements, which is advantageous in that, after concrete has been poured over the construction element, the top reinforcement is entirely surrounded by concrete and does not directly make contact with any cavities. At the most will hereby be created a local contact with some of the hollow elements, for example in case the top reinforcement would bend somewhat and would make contact with one of the hollow elements between two supporting parts.

The invention also concerns a method for manufacturing such a construction element, characterised in that this method at least consists of pouring an amount of concrete in a mould in order to form the above-mentioned concrete layer; in providing the concrete layer with a reinforcement, which is provided in the mould before and/or after the concrete has been poured; in providing hollow elements in the concrete before it has hardened, which are provided with locking parts at their bottom sides, so that they rest in the concrete at least with these locking parts; and in letting the concrete harden, after which the whole is removed from the above-mentioned mould. By fixing the above-mentioned elements defining the cavities directly in the concrete layer by means of locking means, whereby these locking means either exclusively work in conjunction with the concrete or also work in conjunction with a reinforcement provided in the concrete layer, this offers the advantage that no additional steps are required, nor any additional accessories need to be used to provide for a locking from the top.

In a practical embodiment, the hollow elements will be taken automatically from a stock of such elements and will be automatically provided in the concrete with the above-mentioned locking parts, such by means of a vibrating motion, the creation of a vacuum, etc.

DESCRIPTION OF THE DRAWINGS

In order to better explain the characteristics of the invention, the following preferred embodiment is described as an example only without being limitative in any way, with reference to the accompanying drawings, in which.

DETAILED DESCRIPTION OF THE PREFERRED EMBODIMENTS

Figure 1:
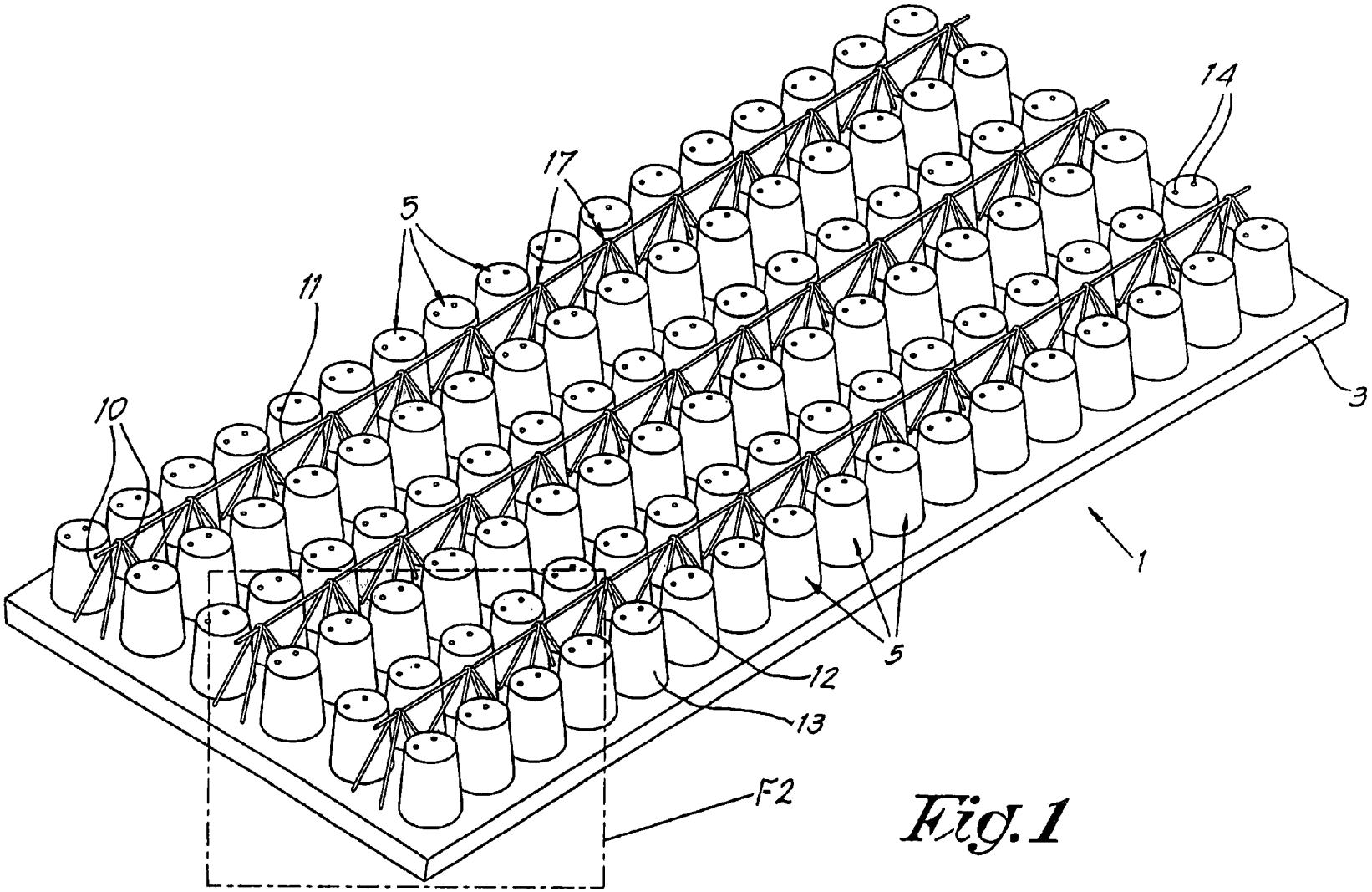
FIG. 1 represents a construction element according to the invention in perspective.
Figure 2:
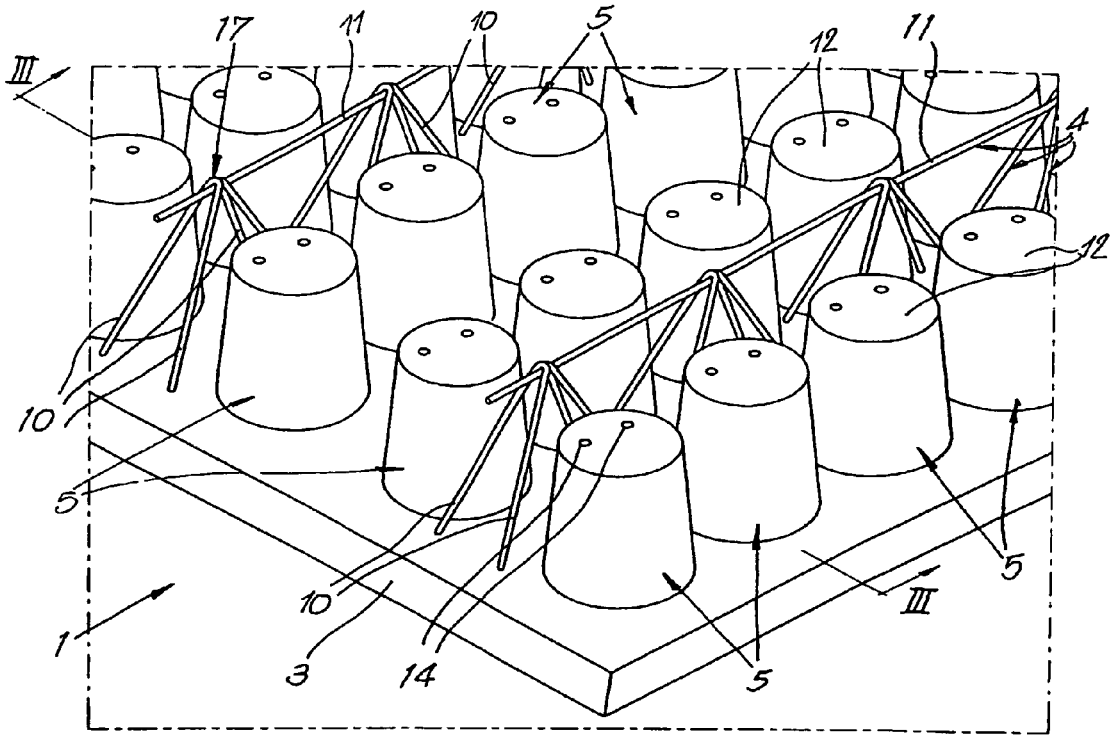
FIG. 2 represents the part indicated with F2 in FIG. 1 to a larger scale.
Figure 3:
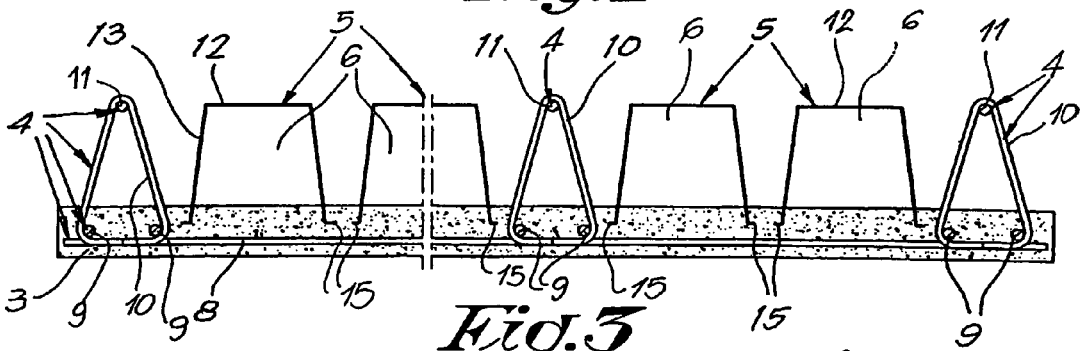
FIG. 3 represents a section according to line III-III in FIG. 2.
Figure 4:
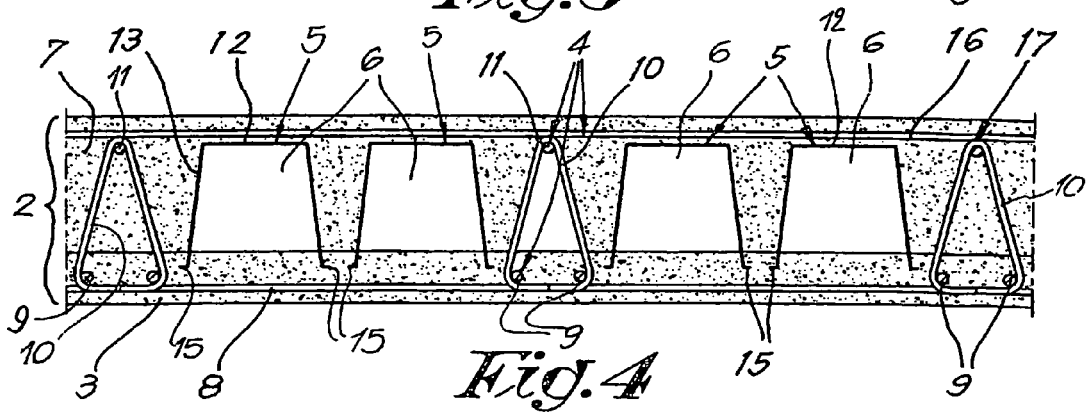
FIG. 4 represents a section of a concrete slab made on the basis of the construction element according to FIG. 1.

As represented in FIGS. 1 to 3, the invention concerns a construction element 1 with which can be made a self-supporting reinforced concrete slab 2, as represented in FIG. 4.

The construction element 1 mainly consists of the combination of at least a hardened concrete layer 3, at least a number of reinforcement elements 4 and elements 5 extending at least partially from the concrete layer 3 and defining cavities 6, whereby these elements 5 are designed to be covered with concrete 7 at a later stage, as can be seen in FIG. 4.

In the given example, the reinforcement elements 4 consist of reinforcement rods 8-9 in the concrete layer 3, as well as of reinforcement rods 11 born by supports 10 situated at a height above the concrete layer 3. The reinforcement rods 8-9 may consist of separate rods or they may also be part of a reinforcement net.

Figure 6:
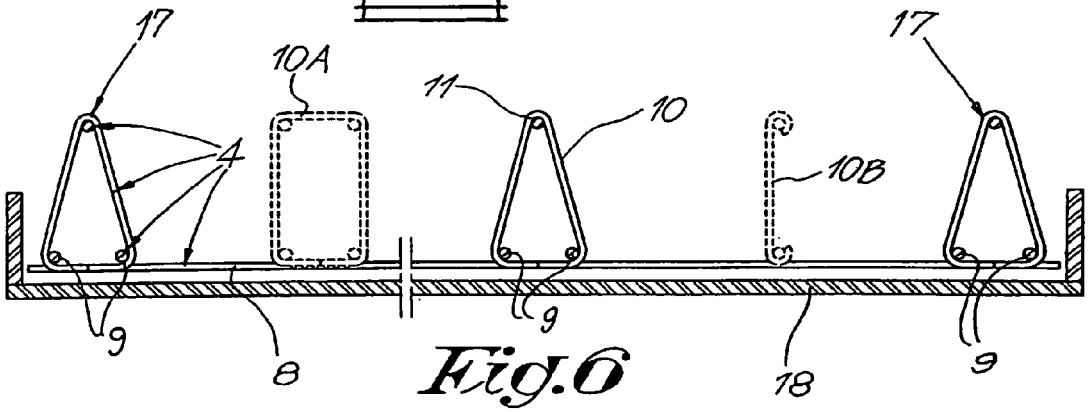
FIGS. 6 to 8 show how the construction element according to the invention can be manufactured.

Although in the figures, the supports 10 are made triangular, also other shapes are possible, such as for example a rectangular shape or a C shape as represented by a dashed line in FIG. 6 and indicated with 10A and 10B.

Figure 5:
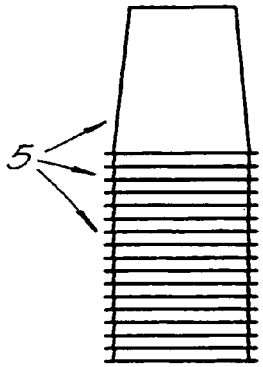
FIG. 5 represents a number of elements of the construction element from FIG. 1, when stacked.

According to a particular detail of the invention, the above-mentioned elements 5 consist of elements which can be mutually nested as such, whereby they can be nested in each other preferably for at least 50%, and better still for at least 75%, as is for example schematically represented in FIG. 5, which results in the advantages as mentioned in the introduction.

The elements 5 are made in the shape of a flower pot which has been turned upside down or a truncate cone; also, they have a top wall 12 and a conical side wall 13, yet which is circular in the cross section. On the bottom side, every element 5 is open, however.

The elements 5 may also have other shapes, such as for example the shape of a truncate pyramid or of other conical shapes narrowing towards the top.

Moreover, every element 5 is made in one piece, preferably of plastic, in particular PVC.

In the top wall 12 and/or in the side wall 13 have been formed air holes 14 with relatively small dimensions, so that, when concrete 7 is poured over them, the cavities 6, which constitute an open volume, will not be filled with concrete.

The elements 5 are provided with locking parts at the bottom, in this case a laterally extending collar 15, provided on the entire perimeter of every element 5, in a continuous or discontinuous manner, meant to be embedded in the concrete layer 3, as represented.

Also, the elements 5 are embedded in the concrete of the concrete layer 3 with their lower part, in particular with the collar 15. Also, in the given embodiment, the embedded part forms the sole anchoring of said elements 5.

It should be noted that this anchoring is made such that, for example as the collar 15 has been selected sufficiently large, the elements 5 remain at least anchored against floating when liquid concrete or cast concrete 7 is poured over them, as well as against any movement whatsoever as a result thereof.

In the given example, the elements 5 are merely embedded in the concrete of the concrete layer 3, preferably without making any contact with the reinforcement rods 8-9; yet, it is clear that, according to a variant, these elements 5 could also catch behind the reinforcement rods 8 and/or 9, for example that they could be pressed behind them with their edges, in order to obtain an even better anchoring.

The elements 5 have been erected in rows in orthogonal directions, but it is clear that, according to a variant which is not represented here, also other set-ups are possible.

The above-mentioned reinforcement rods 11 form supporting means for a top reinforcement 16 which, as represented in FIG. 4, is usually provided in the concrete 7. These supporting means, which could also be formed in any other way whatsoever, define supporting parts 17 for the top reinforcement 16 which are situated higher than the top sides of the above-mentioned elements 5.

The construction element 1 is commercialised in the shape as represented in FIG. 1. When used, it is first put on bearing walls or the like, after which the top reinforcement 16 is provided on it. Next, the concrete 7 is poured over the latter, in the factory or at the building site, so that a condition is obtained as represented in FIG. 4.

Figure 7:
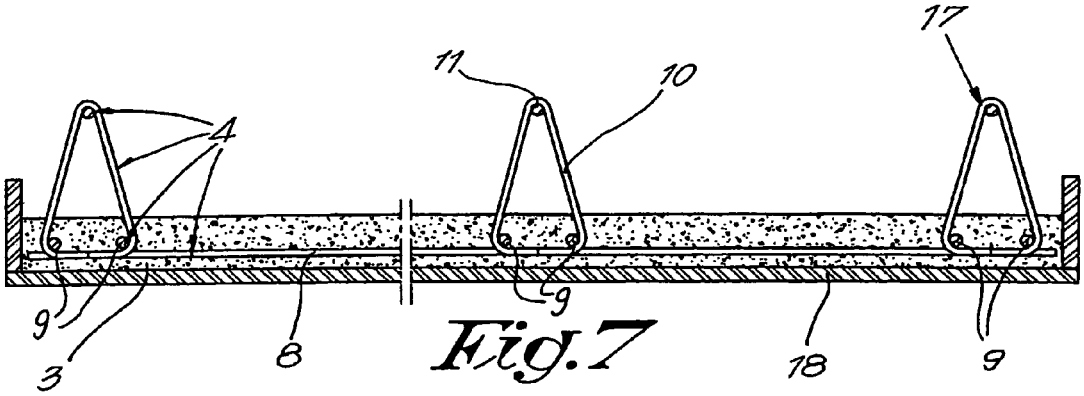
Figure 8:
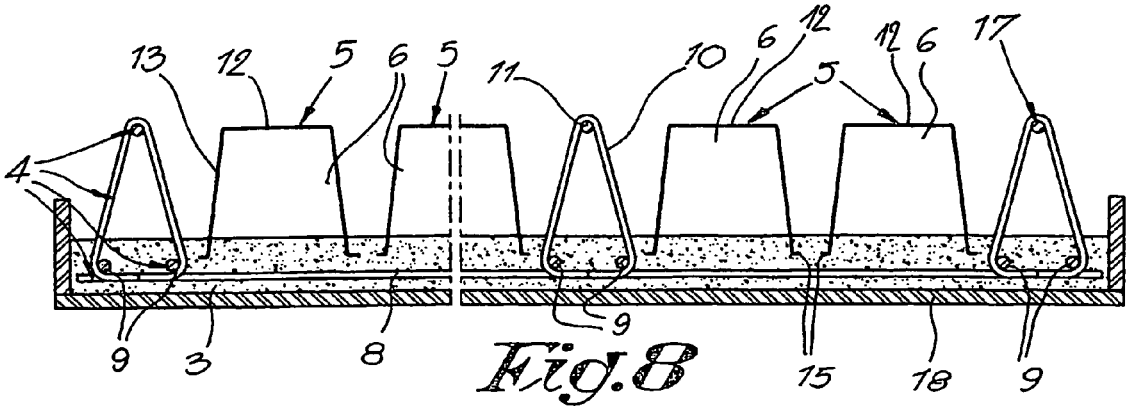

The construction element 1 can be made in the manner as represented in FIGS. 6 to 8. FIG. 6 shows how the reinforcement elements 4 are provided in a mould 18 for pouring the concrete layer 3. The support can hereby be provided in any way whatsoever, and hence this is not represented. Next, the concrete for the concrete layer 3 is poured in the mould 18, as a result of which a condition as represented in FIG. 7 is obtained.

In principle, one could also act vice versa, whereby the concrete for the concrete layer 3 is first poured in the mould 18 and the reinforcement elements 4 are subsequently lowered in it.

While the concrete is still sufficiently fluid, the elements 5 are provided in it. This is preferably done automatically, by taking a series of elements 5 from a stock and by putting them with their lower edges in the concrete layer 3, pressing them down in it respectively, preferably by means of a vibrating motion, the creation of a vacuum, etc. As the elements 5 are provided with air holes 14, the concrete will reach the same level in the cavities 6 as outside the elements 5, so that the lower edge of the elements 5 will be efficiently embedded in the concrete concerned.

After the whole has hardened, it can be removed from the mould 18, as a result of which a construction element 1 as represented in FIG. 1 is obtained.

It is clear that different variants are possible. Thus, for example the elements 5 must not necessarily have the shape of a flower pot which has been turned upside down. They can also be made rectangular instead of circular.

According to a variant, also locking parts having another shape than the collar 15 can be formed on the lower side of the elements 5. Thus, for example, lips, legs or the like can be provided on the lower side of the elements 5, which have locking parts at the bottom which are embedded in the concrete of the concrete layer 3 and/or which are connected to the reinforcement elements 4, whereby the actual lower edge of the elements 5 does not necessarily have to reach into the concrete layer 3.

The present invention is by no means limited to the above-described embodiments given as an example and represented in the accompanying drawings; on the contrary, such a construction element as well as the method for manufacturing it can be made in all sorts of variants while still remaining within the scope of the invention.

The invention claimed is:

1. A construction element for forming a reinforced concrete slab, comprising at least a lower hardened concrete layer, at least a number of reinforcement elements embedded in the concrete layer and extending upwardly therefrom and cavity defining elements embedded in and extending at least partially upwardly with the reinforcement elements from the concrete layer and defining cavities, wherein the cavity defining elements and the lower concrete layer are configured to be covered over with concrete at a later stage, and said cavity defining elements are configured so as to be mutually nestable with each other before being embedded in the concrete layer and comprise side walls and a top wall defining an open volume between the side walls, top wall and the hardened concrete layer, and at least one air hole in the cavity defining element.

2. The construction element according to claim 1, wherein the cavity defining elements are nestable with each other over at least 50% of their heights.

3. The construction element according to claim 1 wherein the cavity defining elements have one or more characteristics selected from the group consisting of said cavity defining elements are made mainly conical;

are open on the bottom side;

have the shape of an inverted flower pot;

are each made in one piece;

are made of plastic material, are circular in horizontal cross section; and are provided with locking parts at their bottom ends which are configured to be embedded in the concrete layer, thereby enabling catching of the locking parts behind reinforcement elements.

4. The construction element according to claim 1, wherein the cavity defining elements have a lower part situated in the concrete of the hardened concrete layer.

5. The construction element according to claim 1, wherein the cavity defining elements are anchored to the construction element, solely via a part thereof embedded in the concrete layer.

6. The construction element according to claim 5, wherein the cavity defining elements are anchored to the construction element in such a way that the cavity defining elements at least remain anchored against floating and possible other forces when liquid concrete or cast concrete is poured over said cavity defining elements.

7. The construction element according to claim 5, wherein anchoring of said cavity defining elements is obtained by means of locking parts provided on the cavity defining elements, said locking parts at least including a laterally extending collar.

8. The construction element according to claim 1, wherein the cavity defining elements are erected in rows in orthogonal directions.

9. The construction element according to claim 1, including a supporting device arranged to support a top reinforcement, said supporting device defining supporting parts which are located higher than the top sides of the cavity defining elements.

10. The construction element according to claim 9, wherein the supporting parts are formed of reinforcement rods extending mainly parallel to the concrete layer.

11. The construction element according to claim 1, including reinforcement elements in the concrete layer and wherein the cavity defining elements are anchored in the concrete layer without contacting said reinforcement elements.

12. A construction element for forming a reinforced concrete slab, comprising at least a lower hardened concrete layer, at least a number of reinforcement elements embedded in the concrete layer and extending upwardly therefrom and cavity defining elements embedded in and extending at least partially upwardly with the reinforcement elements from the concrete layer and defining cavities, wherein the cavity defining elements and the lower concrete layer are configured to be covered over with concrete at a later stage, and said cavity defining elements are mutually nestable with each other before being embedded in the concrete layer; wherein the cavity defining elements have one or more characteristics selected from the group consisting of:

said cavity defining elements are made mainly conical;

comprise one or more side walls and a top wall, and are open on the bottom side;

have the shape of an inverted flower pot;

are each provided with at least one air hole;

are each made in one piece;

are made of plastic material, are circular in horizontal cross section; and are provided with locking parts at their bottom ends which are configured to be embedded in the concrete layer, thereby enabling catching of the locking parts behind reinforcement elements.

* * * * *